US005125522A

United States Patent [19]

Pezzoli et al.

[11] Patent Number: 5,125,522

[45] Date of Patent: Jun. 30, 1992

[54] ENTERAL DELIVERY SET ASSEMBLY

[75] Inventors: Paul A. Pezzoli, Worthington, Ohio; Thomas Joyce, Libertyville; Mark Larkin, Lindenhurst, both of Ill.

[73] Assignee: Abbott Laboratories, Abbott Park, Ill.

[21] Appl. No.: 288,384

[22] Filed: Dec. 22, 1988

[51] Int. Cl.[5] ..... B65D 41/20

[52] U.S. Cl. ..... 215/250; 215/308; 215/DIG. 3; 220/278

[58] Field of Search ..... 215/247, 248, 250, 308, 215/DIG. 3; 220/258, 277, 278, 266, 279

[56] References Cited

U.S. PATENT DOCUMENTS

| | | | |
|---|---|---|---|
| 3,156,383 | 11/1964 | Melli | 215/250 |
| 3,339,812 | 9/1967 | Meissner | 220/278 |
| 4,235,344 | 11/1980 | Kulle et al. | 215/250 |
| 4,754,889 | 7/1988 | Debetencourt | 215/232 |
| 4,770,305 | 9/1988 | Su | 215/250 |
| 4,792,053 | 12/1988 | Towns et al. | 215/250 |
| 4,793,122 | 12/1988 | Towns et al. | 215/250 |
| 4,793,503 | 12/1988 | Towns et al. | 215/250 |
| 4,793,505 | 12/1988 | Towns et al. | 215/250 |
| 4,884,705 | 12/1989 | Debetencourt | 215/250 |
| 4,898,293 | 2/1990 | Morel | 215/250 |
| 4,934,545 | 6/1990 | Pezzoli et al. | 215/250 |

*Primary Examiner*—Stephen Marcus
*Assistant Examiner*—Paul Schwarz
*Attorney, Agent, or Firm*—Donald O. Nickey; E. H. Gorman, Jr.; Lonnie R. Drayer

[57] ABSTRACT

A closure which permits the opening of a membrane seal of an enteral nutritional product container in a single-action motion while maintaining product sterility. This closure includes a general cylindrical side wall having threads along the inner surface thereof, a planar top surface having first and second upwardly extending projections. The first projection is associated with a filter means for allowing air to enter the container, while the second projection has a base which is a spikable membrane. A bottom surface having an annular raised portion is provided. The bottom surface has a downwardly projecting plow member as well abutting against gasket means positioned between the annular raised portion and the inner surface of the side wall.

13 Claims, 2 Drawing Sheets

ENTERAL DELIVERY SET ASSEMBLY

TECHNICAL FIELD

The present invention relates generally to an enteral delivery set assembly, and more particularly, to a closure which permits the opening of the membrane seal of an enteral nutritional product container in a single-action motion while maintaining product sterility.

BACKGROUND ART

Many individuals in health care facilities are able to achieve sufficient caloric intake through eating prepared meals. However, a sizable number of such patients are unable to ingest enough food to meet their body's needs. Examples of these individuals would include burn patients, whose daily caloric needs are often in excess of 5,000 calories, and critically ill, weak, or comatose patients who may be unable to chew their food. For these patients, caloric supplementation through parenteral, also known as intravenous, feeding is not a viable alternative.

In response to this problem, liquid foods have been developed for enteral feeding. Enteral feeding is providing nourishment through the oral tract by defined nutritional diets. Typically, enteral feeding utilizes a nasogastric tube to transport the liquid nutritional products from the container through the patient's nasal cavity and thence into the stomach. Early enteral nutritional product containers were empty, sterilized pouches which were filled with sterilized, canned product at the point of use. The filled pouch was ultimately spiked by a cannula. However, there are shortcomings associated with that type of packaging including potential product contamination and extensive set-up-time. In response to that problem, a multi-layer plastic bottle was developed having a central layer which provided an oxygen barrier, therefore permitting the bottle to be pre-filled with food product which provided greater shelf-life and less spoilage. This type of plastic bottle utilizes a membrane which must be pierced so as to permit the commencement of the feeding process.

Unfortunately, three problems have plagued the prior art pre-filled industry which now experiences annual sales of over $500,000,000. The first problem involves the potential for contamination of the nutrition product by the conventional use of a tool or finger to pierce the heat-sealed membrane. The contamination of the product with bacteria from a non-sterilized tool or from the hands of a health care worker can result in the patient ingesting spoiled food product without his knowledge, since enteral feeding involves no sensation of taste to warn the patient of the spoilage.

The second problem involves the actual piercing of the heat-sealed membrane by a cannula. The health care worker after insertion of a cannula through a closure on existing enteral nutritional product containers is unable to determine the extent to which, if any, the seal has been broken. This problem is acerbated by the physical makeup of enteral nutritional products. Enteral nutritional products are dissimilar from fluids introduced by intravenous feeding primarily due to the presence of minerals and other solids which tend to form a sediment which settles to the bottom of the inverted container during feeding. Additionally, enteral nutritional products are more viscous than intravenous solutions. Due to the physical properties of enteral nutritional products, there is a strong tendency for the food product to deform the broken seal, perhaps even partially occluding the opening, and thus restricting the amount of food product which is being dispensed to the patient. In fact, the possibility exists for complete occlusion of the opening and hence termination of the feeding process.

The third problem relates to the cannulation process, which periodically requires the introduction of a small amount of atmospheric air to preclude the establishment of a vacuum in the system, which would also terminate the feeding process. This problem has traditionally been overcome by the providing of a valve means to introduce atmospheric air into the enteral nutritional product container. A problem arises if the air which is being introduced into the container enters the cannula, instead of rising through the food product, such that aspiration takes place.

Ported closures are well known, an example of which is Steidley, U.S. Pat. No. 4,022,258 which discloses a closure for surgical irrigation fluid containers. Steidley discloses a large spiked member which can pierce a plastic cap having an annular top wall which functions as the original closure for the bottle of surgical irrigation fluid, thereby obviating the need for a heat-sealed membrane. However, Steidley does not address the unique problems associated with the physical composition of enteral nutritional products.

It is thus apparent that the need exists for an improved closure for a pre-filled, membrane-sealed enteral nutritional product container which permits the use of "spike"-type delivery sets which provides system seal integrity, as well as permitting the opening of the nutritional products container in a single-action motion while maintaining product sterility.

DISCLOSURE OF THE INVENTION

There is disclosed a closure for a membrane-sealed product container, said closure comprising, a generally cylindrical side wall, said side wall having threads along the inner surface thereof for threadedly engaging the neck of said container, a planar top surface, said top surface having first and second projections extending upwardly therefrom, said first projection associated with filter means which allows air to enter said container, said second projection having a base which is a spikable membrane, and a bottom surface, said bottom surface having an annular raised portion, gasket means positioned between said annular raised portion and said inner surface, said bottom surface having a downwardly projecting plow.

There is also disclosed a closure for a membrane-sealed container, said closure comprising, a generally cylindrical side wall, and a surface portion having a plow projecting therefrom capable of engagement with the membrane seal of said container, said plow providing a means for rupturing said membrane seal and thus opening said container.

There is also disclosed a closure for a membrane-sealed enteral nutritional product container, said closure comprising, a generally cylindrical side wall, said side wall having threads along the inner surface thereof for threadedly engaging the neck of said container, a planar top surface, said top surface having a first and second generally cylindrically shaped projections extending upwardly therefrom, said first projection associated with filter means which allows air to enter said container, said second projection having a base which is a spikable membrane, and a bottom surface, said bottom surface having an annular raised portion, gasket means positioned between said annular raised portion and said inner surface, the improvement characterized in that said bottom surface has a downwardly projecting plow, said plow having a front face and a rear face, said front face having a cutting edge angled with respect to and shorter in length than said rear face.

The plow member is capable of engagement with the membrane seal of the container, such that the plow provides a means for the rupturing of the seal of said container in a single-action motion while maintaining product sterility. The plow has a front face having a cutting edge, as well as a rear face, with the cutting edge in the preferred embodiment being shorter in length than the rear face, and with the cutting edge and the rear face being angled with respect to one another, with this angle being acute. The spikable membrane permits the insertion therethrough of a cannula for providing friction-fit engagement between the cannula and the closure. To facilitate this engagement as well as permit the spiking of the membrane, the closure is fabricated from a rigid plastic material which is elastic enough to require a withdrawal force of at least 3.6 kilograms (eight pounds) for disengagement of the cannula from the closure, in addition to being elastic enough to require a maximum insertion force of approximately 11.3 kilograms (twenty-five pounds).

The present invention provides an enteral delivery set assembly incorporating a screw cap which permits the opening of a membrane-sealed enteral nutritional product container in a single-action motion while maintaining product sterility.

Yet another important aspect of this invention is to provide an enteral delivery set assembly which does not encounter the problems associated with reliance on the cannula alone to open a membrane-sealed enteral nutritional product container.

Still yet another important aspect of the present invention is to provide an enteral delivery set assembly with the closure having sufficient rigidity to permit the closure to be tightly secured about the neck of the container while having sufficient flexibility to permit a delivery set cannula to pierce the closure membrane as well as being retained in the assembly.

Other aspects and advantages of the invention will be apparent from the following description, the accompanying drawings and the appended claims.

DETAILED DESCRIPTION OF THE INVENTION

Figure 1:
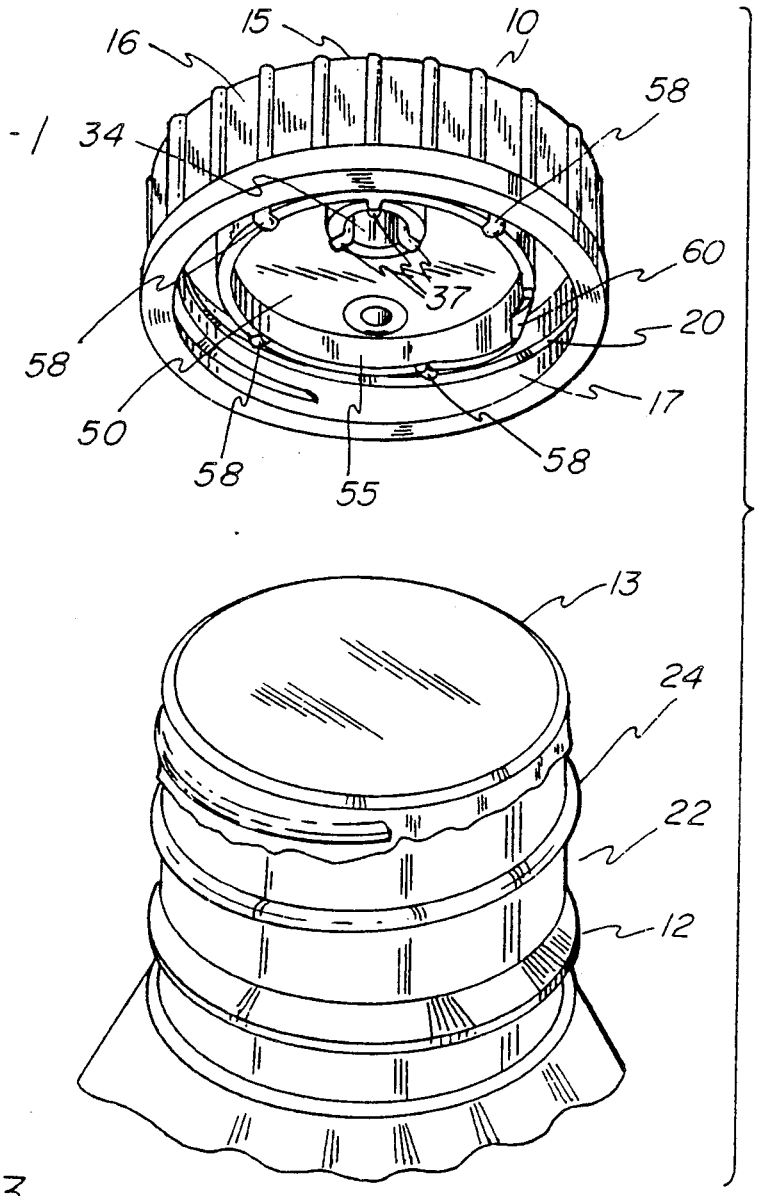
FIG. 1 is a perspective view of the closure which is utilized in an enteral delivery set assembly in accordance with the present invention shown with a portion of an enteral nutritional product container.

Having reference to the drawings, attention is directed first to FIG. 1 which illustrates a closure for an enteral delivery set assembly embodying this invention designated generally by the numeral 10, shown in conjunction with a portion of an enteral nutritional product container 12. The container 12 has a membrane seal 13 which typically is of foil or of thin plastic.

The closure 10 includes as a basic component thereof, cylindrical side wall 15 having an outer surface 16 as well as an inner surface 17. Along the inner surface 17 are threads 20 for threadedly engaging the closure 10 to the neck 22 of the container 12 at the threaded neck portion thereof 24.

Figure 3:
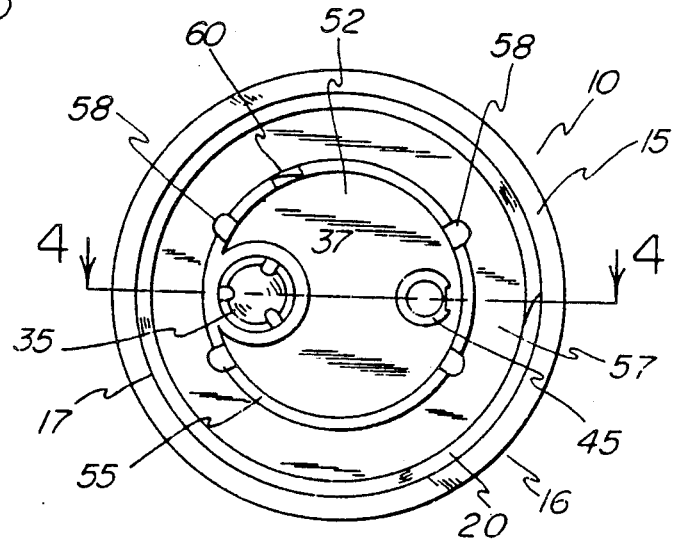
FIG. 3 is a bottom plan view of the closure shown in FIGS. 1 and 2, after cannulation has occurred.
Figure 2:
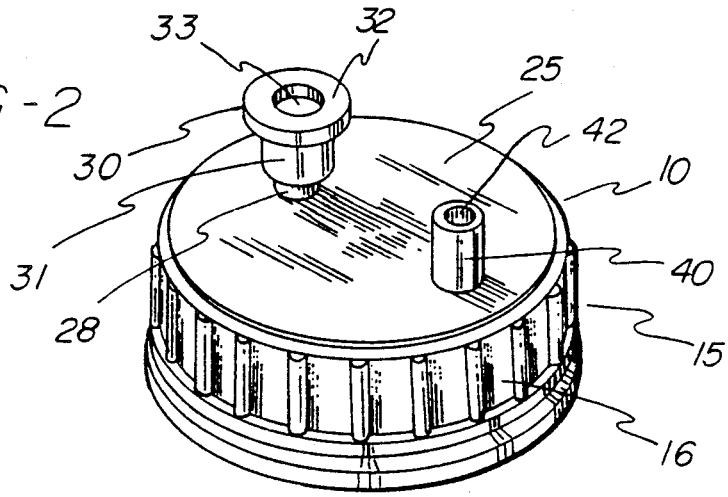
FIG. 2 is a top elevational view of the closure shown in FIG. 1.
Figure 4:
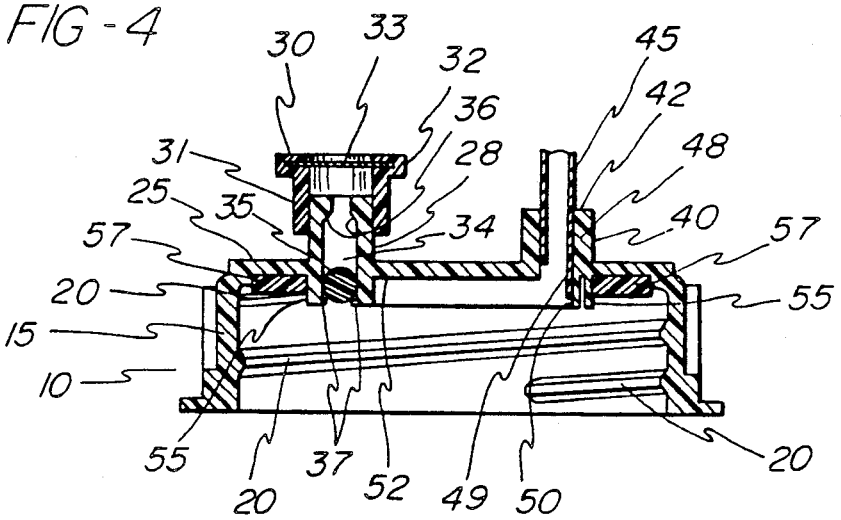
FIG. 4 is a vertical sectional view taken along line 4—4 of FIG. 3, showing the closure of FIGS. 1 and 2 after cannulation has occurred.

As can be better seen in FIG. 2, the closure also includes a top surface 25 preferably having a first projection 28 which is associated with filter means 30. The filter means 30 has a tubular filter side wall 31, along with a filter top surface 32. Also part of the filter means 30 is filter 33. As can be seen in FIGS. 2, 3 and 4, the tubular filter side wall 31 forms a channel 34 into which ball 35 fits. The cooperation between channel 34 and ball 35 acts as a valve to permit air to enter the container to prevent vacuum build-up and thus assist with the flow of product during feeding. When the closure is in its operative mode, the container 12 is inverted such that ball 35 rests against beveled portion 36. At other times, the ball 35 is still retained in the channel 34 by conventional ball retention means 37.

The top surface 25 also has a second projection 40 having an opening 42 at its uppermost end. This opening extends downwardly through said second projection to permit the insertion of a cannula 45 therein. The engaging walls 48 of second projection 40 are of a diameter to permit friction-fit engagement with the walls of cannula 45. The terminal end of the cannula forms a sharp tip 49 which is capable of spiking membrane 50 of closure 10. Once spiked, a portion of the membrane 50 still remains attached to the bottom surface 52 of closure 10 as can be better seen in FIG. 4.

Annular raised portion 55 depends from bottom surface 52. Positioned between the annular ridge 55 and inner surface 17 is a gasket 57, which may be held in place if necessary by gasket retaining means 58. These gaskets retaining means may be little more than a semi-rigid flap or an outwardly radiating flange associated with the free end of the annular raised portion 55.

Figure 5:
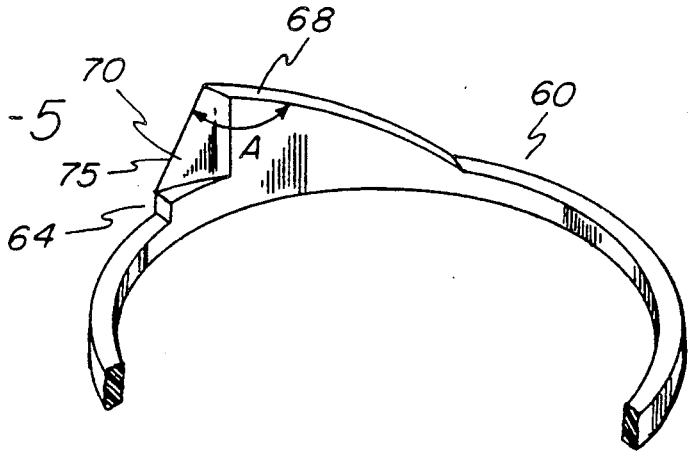
FIG. 5 is a perspective view on a greatly enlarged scale of the plow member shown in FIGS. 1 and 3.

Projecting from the bottom surface 52, preferably from annular ridge 55 is a plow member 60. The plow 60, as can best be seen in FIG. 5, has a front face 64 and rear face 68. The front face 64 has a blade portion 70 having a cutting edge 75. As can be seen, the blade portion 70 is angled with respect to the rest of the front face 64. In the preferred embodiment of this invention, an acute angle A is associated with the angle between cutting edge 75 and rear face 68. It will also be appreciated that, in this embodiment, the cutting edge is shorter in length than the rear face.

Although prior closures have been fabricated from plastic, the choice of material in this invention is critical. While the closure must be fabricated from a material strong enough to exert a fair amount of torque when the enteral delivery set assembly is screwed onto a nutritional product container 12 and strong enough to provide a means for opening the membrane sealed container when it is engaged therewith, the material must be elastomeric enough to permit its membrane to be spikable. To this end it has been found that the desirable material should have a withdrawal force of at least 3.6 kilograms (eight pounds) associated with the disengagement of the cannula 45 from the closure, and additionally require an insertion force of approximately 11.3 kilograms (twenty-five pounds) for spiking or rupturing of the spikable membrane. One such composition involves a mixture of polypropylene and a thermoplastic elastomer, e.g. styrene-butadiene block copolymer, or ethylene vinyl acetate. Furthermore, the gasket may be formed from a thermoplastic elastomer although ethylene vinyl acetate and high density polyethylene foam could be substituted therefor. Finally, Gortex, a well-known semi-permeable, hydrophobic fiber material may be used to fabricate the filter.

BEST MODE

In actual operation, the closure is placed onto the top of the neck, such that as the closure is screwed-on, the plow engages with and tears the membrane seal of the container. Due to the torquing forces of the plow and the forces associated with the membrane-sealed top of the container, it has been found that the tearing of the seal, while opening the container in a single-action motion, results in an uneven seal as well as having the opening encompass an area much greater than that formerly associated with the piercing of the seal by cannulation. Thus the potential for problems with aspiration or occlusion are precluded, due to the presence of the plow. Further, the plow maintains, to a greater degree than was formerly possible, product sterility by eliminating the use of a tool or finger to effectively open the membrane seal.

INDUSTRIAL APPLICABILITY

This $500,000,000 industry has long sought ways to solve problems with contamination, occlusion and aspiration. This invention solves this long felt need. While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A closure for a membrane-sealed nutritional product container, said closure comprising, a generally cylindrical side wall, said side wall having threads along the inner surface thereof for threadedly engaging the neck of said container, a planar top surface, said top surface having first and second projections extending upwardly therefrom, said first projection associated with filter means which allows air to enter said container, said second projection having a base which is a spikable membrane, and a bottom surface, said bottom surface having an annular raised portion, gasket means positioned between said annular raised portion and said inner surface, said bottom surface having a downwardly projecting plow.

2. The closure as claimed in claim 1 wherein said first and second projections are generally cylindrical.

3. The closure as claimed in claim 1 wherein said plow has a front face, said front face having a cutting edge, and said plow has a rear face.

4. The closure as claimed in claim 3 wherein said closure is formed of a rigid plastic material.

5. The closure as claimed in claim 4 wherein said plow depends from said annular raised portion.

6. The closure as claimed in claim 4 wherein said cutting edge is shorter in length than said rear face.

7. The closure as claimed in claim 4 wherein said cutting edge and said rear face are angled with respect to one another, with said angle being acute.

8. The closure as claimed in claim 7 wherein said cutting edge is shorter in length than said rear face.

9. A closure for a membrane sealed enteral nutrition container, said closure comprising: a generally cylindrical side wall having threads along the inner surface thereof for threadedly engaging the neck of said container; and a surface portion, said surface portion having a plow projecting therefrom capable of engagement with the membrane seal of said container. said plow having a front face and a rear face with the front face having a cutting edge, said closure being formed of a rigid plastic material, said plow providing a means for rupturing said membrane seal and thus opening said container, and said surface portion including a spikable membrane for insertion therethrough of a cannula.

10. The closure as claimed in claim 9 wherein said cutting edge is shorter in length than said rear face.

11. The closure as claimed in claim 9 wherein said cutting edge and said rear face are angled with respect to one another, with said angle being acute.

12. The closure as claimed in claim 11 wherein said cutting edge is shorter in length than said rear face.

13. A closure for a membrane-sealed enteral nutritional product container, said closure comprising, a generally cylindrical side wall, said side wall having threads along the inner surface thereof for threadedly engaging the neck of said container, a planar top surface, said top surface has first and second generally cylindrically shaped projections extending upwardly therefrom. said first projection associated with filter means which allows air to enter said container, said second projection having a base which is a spikable membrane, and a bottom surface, said bottom surface having an annular raised portion, gasket means positioned between said annular raised portion and said inner surface, the improvement characterized in that said bottom surface has a downwardly projecting plow, said plow having a front face and a rear face, said front face having a cutting edge angled with respect to and shorter in length than said rear face.

* * * * *